United States Patent [19]

Dysarz

[11] 4,065,934

[45] Jan. 3, 1978

[54] RIG TRANSPORT METHOD

[75] Inventor: Edward David Dysarz, Houston, Tex.

[73] Assignee: James G. Brown & Associates, Inc., Houston, Tex.

[21] Appl. No.: 639,431

[22] Filed: Dec. 10, 1975

[51] Int. Cl.[2] ..... E02B 17/04

[52] U.S. Cl. ..... 61/87; 61/91; 61/97; 114/258

[58] Field of Search ..... 61/46.5, 90, 87, 92, 61/97, 96, 91; 114/43.5, .5 D, 264

[56] References Cited

U.S. PATENT DOCUMENTS

| | | | |
|---|---|---|---|
| 2,592,448 | 4/1952 | McMenimen | 61/46.5 |
| 3,044,269 | 7/1962 | Le Tourneau | 61/46.5 |
| 3,716,993 | 2/1973 | Sumner | 61/46.5 |
| 3,727,414 | 4/1973 | Davies | 61/46.5 |

*Primary Examiner*—Jacob Shapiro
*Attorney, Agent, or Firm*—David M. Ostfeld; Murray Robinson; Ned L. Conley

[57] ABSTRACT

A mobile jack-up drilling rig for offshore use is uniquely designed to greatly reduce the weight of the entire assembly by using a light, openwork body or superstructure thereby eliminating the requirement that the rig be seaworthy and either partially or totally eliminating the requirement that the rig be buoyant. The jack-up rig requires assistance to be carried to the drill site. The system includes a truss design with little or no hull, using structural shapes for a superstructure whose sizes are dependent on weights and spans. The superstructure is supported by cylindrical, trussed, or other suitably shaped legs. Preload pods, which may be of any shape such as round, may be provided at each of the legs to attach to the superstructure. The preload pods, preferably, support the jacks used to raise and lower the legs. A minimum amount of drilling and support equipment, housings, and machinery is usually located on the rig to further lower weight and to make the rig small and light for transporting to the drilling site. The rig may be designed for tender assistance, the tender housing such equipment as drill pipe, mud pumps, and providing quarters. The machinery located on the rig may include the drill works, such as, for example, the draw works and rotary. For transportation purposes, the rig will be placed on a carrying vessel, for example, on a tender. When the rig arrives at the drilling site, it may be jacked up off of the carrying vessel by its legs or may be jacked up almost off the tender by its legs and preloaded using the carrying vessel before being jacked to its final position. A curved skid rail may also be incorporated for azimuthally positioning the drill works to drill several wells. The rig, because of its light weight, may be converted to a production rig after drilling operations have been completed.

6 Claims, 20 Drawing Figures

Fig. 1
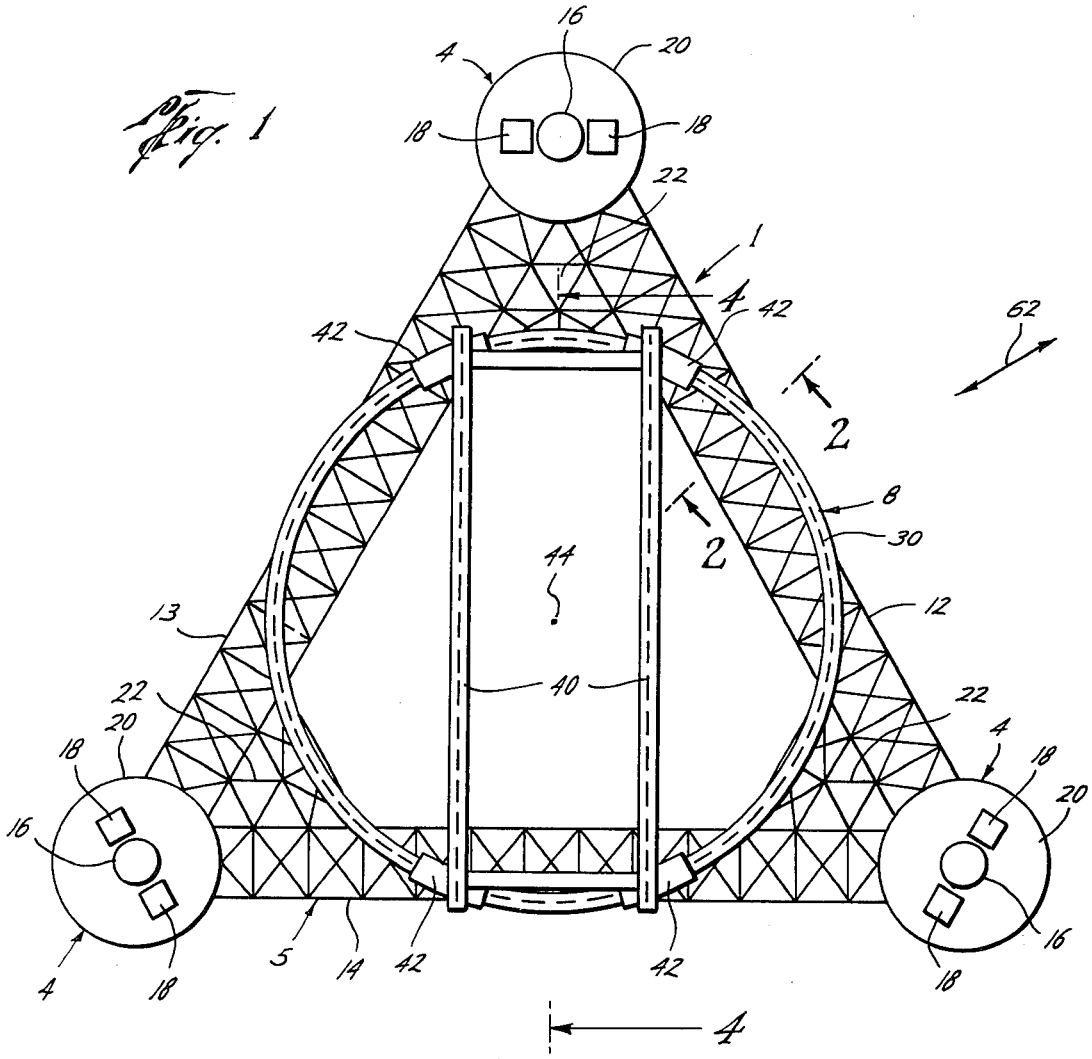
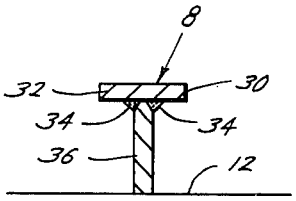
Fig. 2

26
16
28
24
20
18
4
16
200
3
10
202
212
210
7
208
18
20
16
4
60
18
204
240
206
11
53
58
50
226
246
24
242
244

RIG TRANSPORT METHOD

BACKGROUND OF THE INVENTION

1. Field of the Invention

The present invention relates to a drilling rig for offshore use allowing for a lightweight, openwork structure, thereby eliminating the seaworthy requirement of the rig and allowing for versatile positioning of the drill mechanism. The present invention has been found to be particularly useful in the jack-up drilling rig art, and, hence, will be discussed with particular reference thereto. However, the present invention is applicable to other types of drilling rigs requiring lightweight, inexpensive structure as well as flexibility in positioning the equipment mounted on the structure.

2. Description of the Prior Art

A mobile jack-up drill rig is the most stable, versatile and economical offshore drilling unit for operating in water depths of fifty to four hundred feet. In all but the worst sea conditions, a jack-up rig is a stable platform from which drilling operations can be performed efficiently well above the top of the waves. In a moderate storm, a drill ship or a semisubmersible usually must shut down drilling operations due to the high roll angle and pitch angle caused by the wind and waves. A mobile jack-up drilling rig is stable because it is set on the sea floor, which is not affected by the surface sea conditions. It is versatile because it is not limited to any one bottom condition, water depth or geographic location. A mobile, offshore, jack-up drilling rig of the prior art has one disadvantage in that it becomes less competitive economically to build for water depths greater than four hundred feet. To increase the operating depth of a jack-up drill rig using present technology, the distance between the legs is usually made greater, thereby necessitating the addition of more steel between the legs. Additionally, as more steel is added to the hull and to lengthen the legs, more steel must be added to the legs to support the extra weight of the hull and the extra length of the legs.

Several types of jack-up drilling rigs have been known and used before, and typical examples thereof are shown in U.S. Pat. No. 3,183,676, issued May 18, 1965, to R.G. Le Tourneau; U.S. Pat. No. 3,466,878, issued Sept. 16, 1969, to N. Esquillan et al; and U.S. Pat. No. 3,093,972, issued June 18, 1963 to M.R. Ward, Jr. None of these devices, however, teach either a drilling, workover, or crane openwork jack-up rig that is nonseaworthy.

Several types of circular orienting systems have been known and used before, and typical examples thereof are cranes which rotate on an upper circular skid rail and well treatment facilities that mount on an ancillary portion of the hull. None of these teach the use of a curved skid rail in drilling operations to locate drilling equipment.

SUMMARY OF THE INVENTION

The present invention uses a very simple but highly effective design for a jack-up rig including a light openwork rig superstructure to economically extend the water depth capability of jack-up drilling rigs by reducing the weight supported by the legs per foot of water depth as well as to reduce the weight of designs for present water depths. Conventional legs, such as, for example, cylindrical, three chord triangular or four chord square legs, are connected through the jacks to the superstructure to form the jack-up rig. The superstructure includes a truss and member stiffened structure of various configurations, such as, for example, triangular or cross-shape, the structure having negative buoyancy. In the preferred embodiment, the superstructure has no bottom to form a hull.

In the preferred embodiment, the platform structure may further be equipped with a curved skid rail such as a circular skid rail to permit rotation of the drill works about the center of the skid rail for azimuthal positioning of the drillworks. The circular skid rail is, moreover, used in conjunction with conventional skid rails being mounted on the circular skid rail to provide an accurate mechanism for positioning the drill stem at the desired location for the drill hole.

BRIEF DESCRIPTION OF THE DRAWINGS

For a further understanding of the nature and objects of the present invention, reference should be had to the following detailed description of the preferred embodiments thereof, taken in conjunction with the accompanying drawings, in which like parts are given like reference numerals and wherein:

FIG. 1 is a plan view of Embodiment 1 of the apparatus of the present invention;

FIG. 2 is a cross-sectional view of the circular skid rail taken along section lines 2—2 of FIG. 1;

DETAILED DESCRIPTION OF THE PREFERRED EMBODIMENT

Introduction

Figure 3:
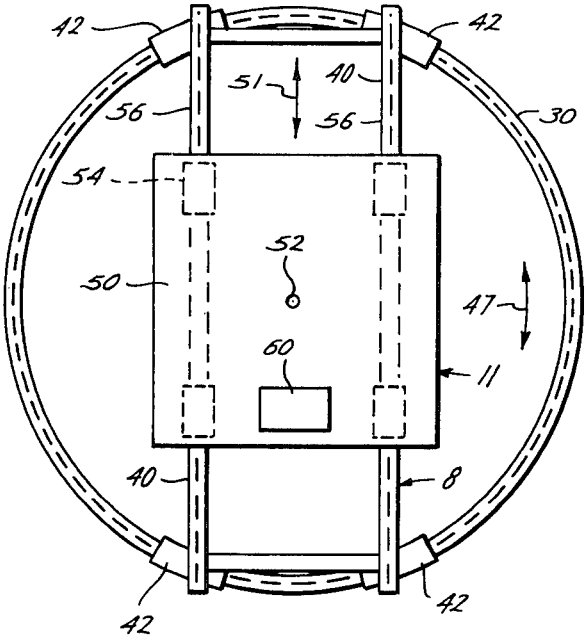
FIG. 3 is a partial top view of the embodiment of FIG. 1 of the apparatus of the present invention showing the drill floor in place on the upper skid rail.
Figure 4:
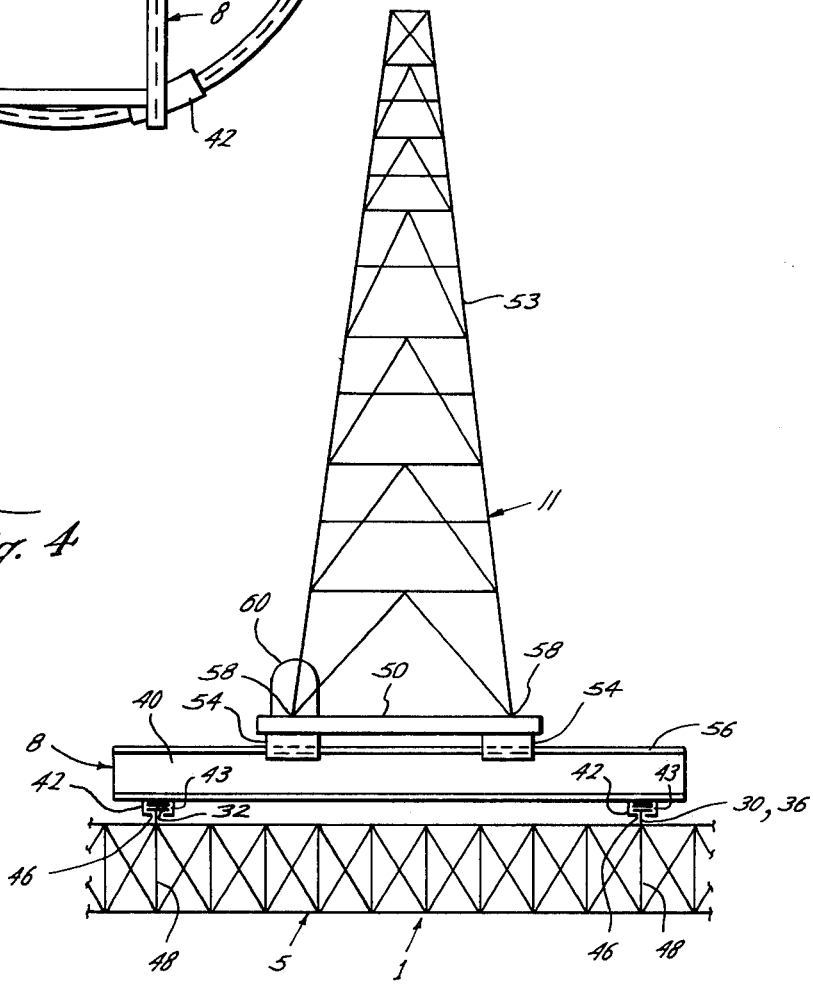
FIG. 4 is a side, partial, cross-sectional view of the platform taken along section lines 4—4 of FIG. 1 and including the upper skid, draw works, drill floor, and derrick in place.
Figure 5:
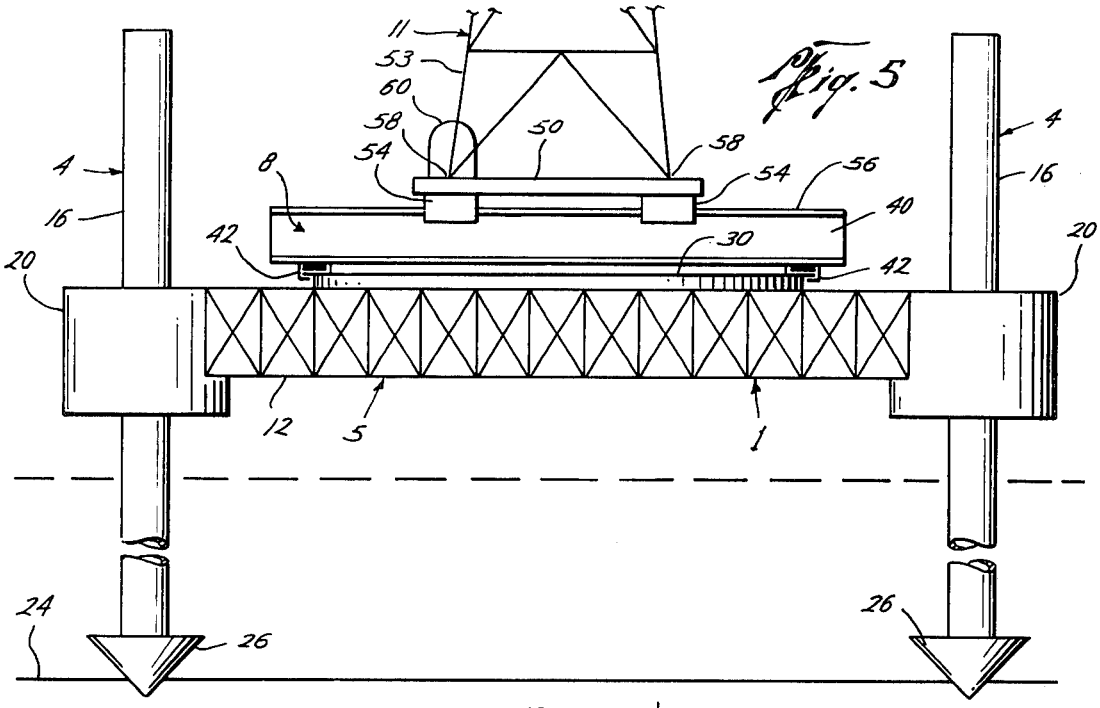
FIG. 5 is a side elevational view of the embodiment of FIG. 1 of the apparatus of the present invention.

The preferred embodiment of the rig of the present invention may be used to support apparatus offshore wherein it is important that a mobile jack-up rig be used in deep waters, such as, for example, greater than 400 feet. The greater depth capability is accomplished by the use of an openwork superstructure for the rig body thereby gaining weight reduction. A particularly important area of application of the present invention is in deep water drilling, crane support or work over, wherein mobile, openwork jack-up rigs are used in a tender assisted or self sustaining manner. However, it should be realized that the present invention could be applied to, for example, any application where it is desired to support and suspend apparatus above a water surface in water depths that may vary from a few feet to deep water.

In the preferred embodiments of the present invention, the openwork superstructure of the rig is formed using truss members.

In the first two embodiments, positioning of the drill works is accomplished partly through the use of a circular skid rail, azimuthally orienting the drillworks.

All three of the preferred embodiments are constructed to permit mounting of the rig, including the superstructure, legs, and preload members, on the deck of a ship, barge, or semisubmersible as a single unit for transportation purposes. Any of these preferred embodiments of the rig may also be transported by dismantling the rig and shipping it in sections with reassembly by welding, bolting, or riveting at a remote location.

The rigs of the embodiments may be tender assisted, and the tender may be a semisubmersible, barge, or ship which could also be used to transport the rig and the equipment to be placed on the rig. The tender may also be used to preload the rig.

Structure of Its Method of Use

As shown generally in FIGS. 1, 4, 5, 6, 8, 10, 11, 12, the preferred embodiments of the rig 1, 2, 3 of the present invention comprise three basic elements. Rig 1, 2, 3 includes leg structures 4 which may be of a truss design such as a three cord triangular, a four cord square, or round or cylindrical shaped as in the preferred embodiment. Rig 1, 2, 3 further includes an openwork body or superstructure of any shape such as triangular 5, cross 6, maltese cross 7, square (not shown) or rectangular (not shown). The body 5, 6, 7 may be trussed as in the preferred embodiments or box beam or other suitable material. Rig 1, 2, 3 further includes skid rail system 8, 9, 10 respectively for supporting drilling works 11.

Drilling works 11 includes a drill floor 50. Usually, the only machinery located on drill floor 50 will be drilling machinery such as, for example, derrick 53 sitting on bases 58, draw works 60 and rotary (not shown). Additionally, one crane (not shown) may be located on the rig or the drill works 11 may be used in place of the crane. All other equipment such as, for example, spare drill pipe, mud pumps, and living quarters may be located on a tender 242 which may be either a barge, ship or semisubmersible connected to the rig 1, 2, 3.

Embodiment 1

Referring particularly to FIGS. 1, 2, 3, 4, and 5, there is shown the triangular configuration of truss rig 1. Leg structures 4 are connected by truss members 12, 13, and 14 to form lightweight, openwork body or truss structure 5 of a triangular shape, truss structure 5 having a negative buoyancy without preload pods 20. The components of truss members 12, 13, 14 may be of any supporting shape construction, such as, for example, structural tubing or wide flange beams.

Each leg structure 4 comprises three elements, a leg 16, jacks 18, and preload pods 20 supporting jacks 18. Legs 16 terminate in the ocean floor 24 with spud cans 26 having projections such as, for example, projections 28 (FIG. 16) stabbed into the ocean bottom 24 to support rig 1 through cylindrical legs 16. Teeth or openings (not shown) on legs 16 are engaged by jacks 18 located on preload pods 20 to fix the length of the legs extending below preload pods 20. The preload pods 20 are attached to truss structure 5 by truss members 12, 13, 14 at the intersection of the members thereby forming the platform. Reinforcing beams 22 are provided at the intersection of truss members 12, 13, 14 at leg structures 4 to distribute the leg load to support the drilling works 11 substructure, and increase the strength of truss structure 5.

Skid rail system 8 is mounted on truss structure 5 and includes lower circular skid rail 30. Skid rail 30 has horizontal member 32 (FIG. 2) welded by welds 34 to vertical member 36 resting on truss members 12, 13, 14 and reinforcing beams 22. The intersections of circular skid rail 30 with the vertical planes of the inboard and outboard sides of truss members 12, 13, 14 usually occur at the location of members 48 of the truss structure. Skid rail system 8 also includes upper parallel skid rails 40 of supporting shape construction such as, for example, structural tubing or wide flange beams mounted on lower skids 42. Lower skids 42 form a channel 43 in cross-section having partial opening 46 to slidingly engage and hold horizontal member 32 of circular skid rail 30. Sufficient clearance is provided with opening 46 to permit bidirectional rotation about the center 44 of lower circular skid rail 30 as shown by directional arrows 47 for azimuthal orientation. As best seen in FIG. 3, upper skids 54 which have the same cross-section as lower skids 42 are connected slidably to horizontal member 56 of the upper skid rails 40 with sufficient clearance for movement thereon. Drill floor 50, having hole 52 therethrough sized to permit lowering of the drill string (not shown) at the center thereof, is mounted on upper skids 54, usually by welding. Therefore, drill floor 50 is bidirectionally moveable along upper skid rails 40 as shown by directional arrows 51. Apparatus well known in the art, such as, for example, shown in brochures of The Rig Skidding Jack manufactured by Joe Stine, Inc. of Houston, Texas or Hydraulic Gripper Jacks manufactured by Hydranautics and distributed by Ocean Supply, Inc. of Houston, Texas may be employed to cause movement of the skids and apparatus thereon with respect to the skid rails.

Derrick 53 rests upon drill floor 50 with the base 58 of derrick 53 located over upper skids 54. Draw works 60 are also located on drill floor 50.

Directional arrow 62 indicates the typical path for ship 64 to take in movement to engage rig 1 for transportation and location purposes. Ship 64 may also approach rig 1 from either of the other two sides in a similar manner.

Embodiment 2

Figure 6:
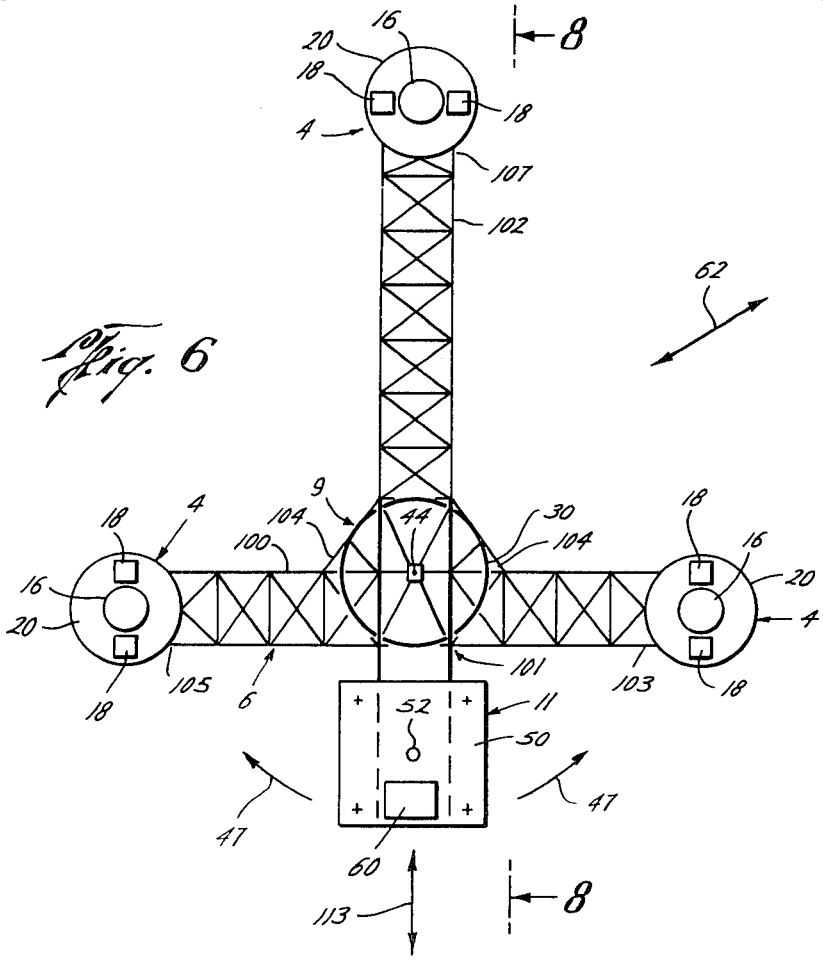
FIG. 6 is a plan view of Embodiment 2 of the apparatus of the present invention.
Figure 7:
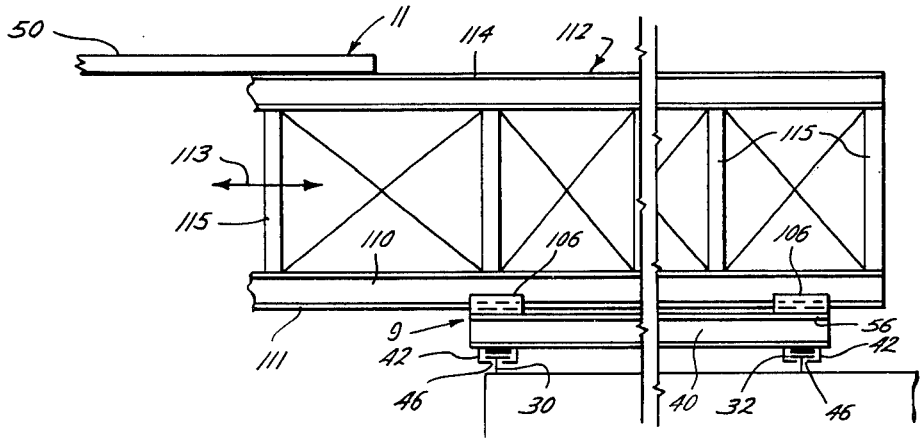
FIG. 7 is a side section taken along section lines 7—7 of FIG. 9.
Figure 8:
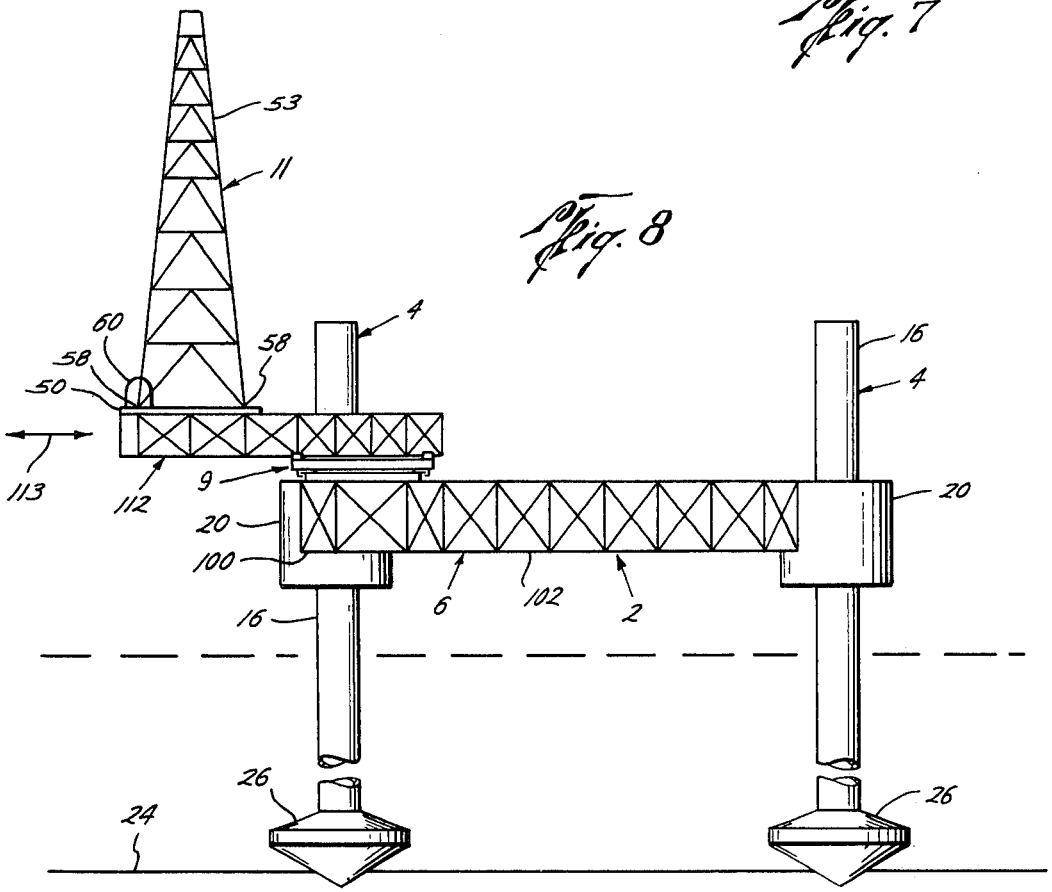
FIG. 8 is a side, cross-sectional view taken along section lines 8—8 of FIG. 6 and including the derrick and draw works in place.
Figure 9:
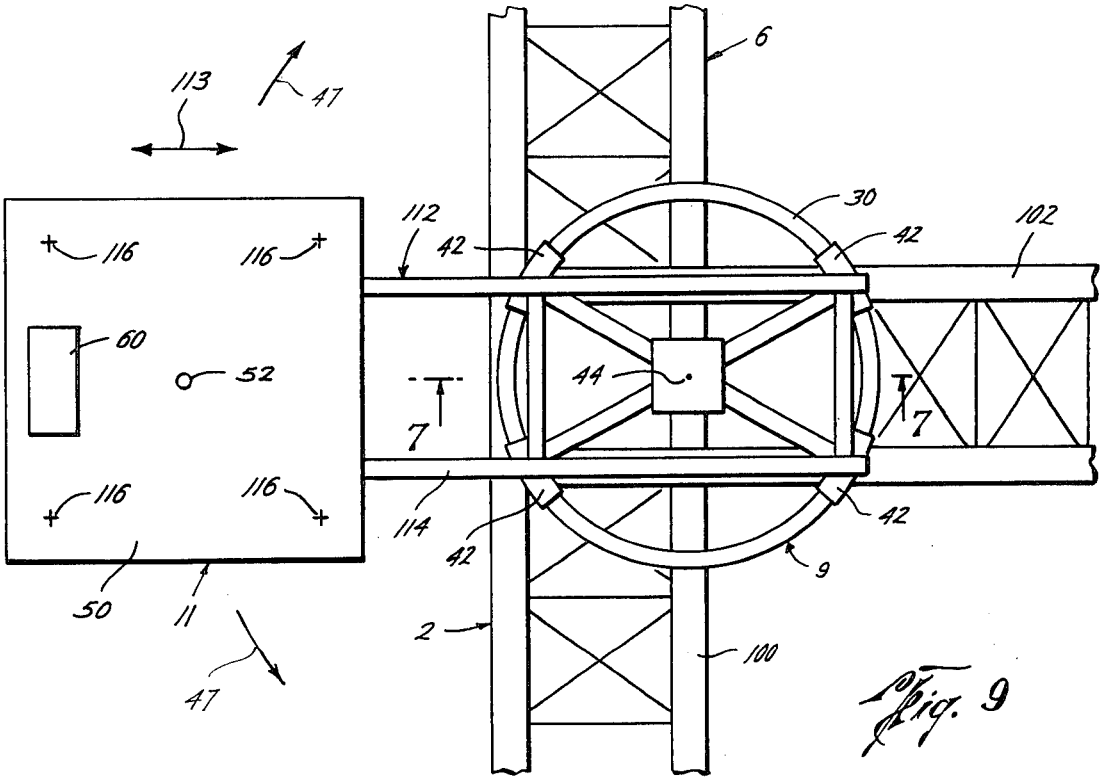
FIG. 9 is a partial top view of the embodiment of FIG. 6 of the apparatus of the present invention.

Referring particularly to FIGS. 6 and 8, rig 2 is a cantilever type rig of a "T" (or cross) configuration rather than triangular. It has the same leg structure 4 as that of rig 1.

Referring to FIGS. 6, 7, 8, and 9, rig 2 includes openwork truss structure 6. Truss structure 6 includes two truss members 100, 102 intersecting each other approximately perpendicularly at 101 with reinforcing members 104 located at the intersection. The components of the truss members are of the same type as rig 1. The ends 103, 105 of truss members 100 and end 107 of the truss member 102 connect to preload pods 20.

Skid rail structure 9, mounted on truss members 100, 102, and reinforcing members 104, includes lower circular skid rail 30 connected to lower skid 42 as previously described for Embodiment 1 to permit rotation of upper skid beam 40 about center 44, lower skid 42 being connected to upper skid 40. Upper skid 106 is mounted by welding or other suitable means on horizontal member 56 of upper skid rails 40 forming a channel about horizontal member 111 of lower flange 110. Upper skid 106 is usually formed in two halves connected to the lower beam 110 of cantilever beam structure 112 by welding with sufficient clearance to permit cantilever beam structure 112 to be moveable on upper skid rails 40 in the directions shown by directional arrows 113.

Because this is a cantilever rig, drill floor 50 is mounted by welding or other suitable connection to upper member 114 of cantilever beam structure 112. Lower member 110 and upper member 114 of cantilever beam structure 112 are joined by vertical risers 115. Drill floor 50, although mounted on upper member 114 of cantilever beam structure 112, is not mounted over upper skid 106. Therefore, the resting points 116 of base 58 of derrick 53 are not normally over upper skids 106.

Circular skid rail 30 permits drill works 11 on drill floor 50 to be rotated about center 44 to position the drill works azimuthally to any angle within 360°, including, but not limited to, the cantilever position for drilling as shown in FIG. 6. Before or after rotation, movement of cantilever beam structure 112 along upper skid rail 40 may be used to appropriately position drill hole 52 with respect to sea floor 24. To prevent contact between drill floor 50 and lugs 4 during rotation, drill floor 50 may be moved at least partially inwardly toward center 44, using upper skid 106 operating with cantilever beam structure 112, prior to rotation about center 44. This would depend on the length of truss beam 100. Movement of the skids with respect to the skid rails may be caused by apparatus as identified in Embodiment 1.

Embodiment 3

Figure 10:
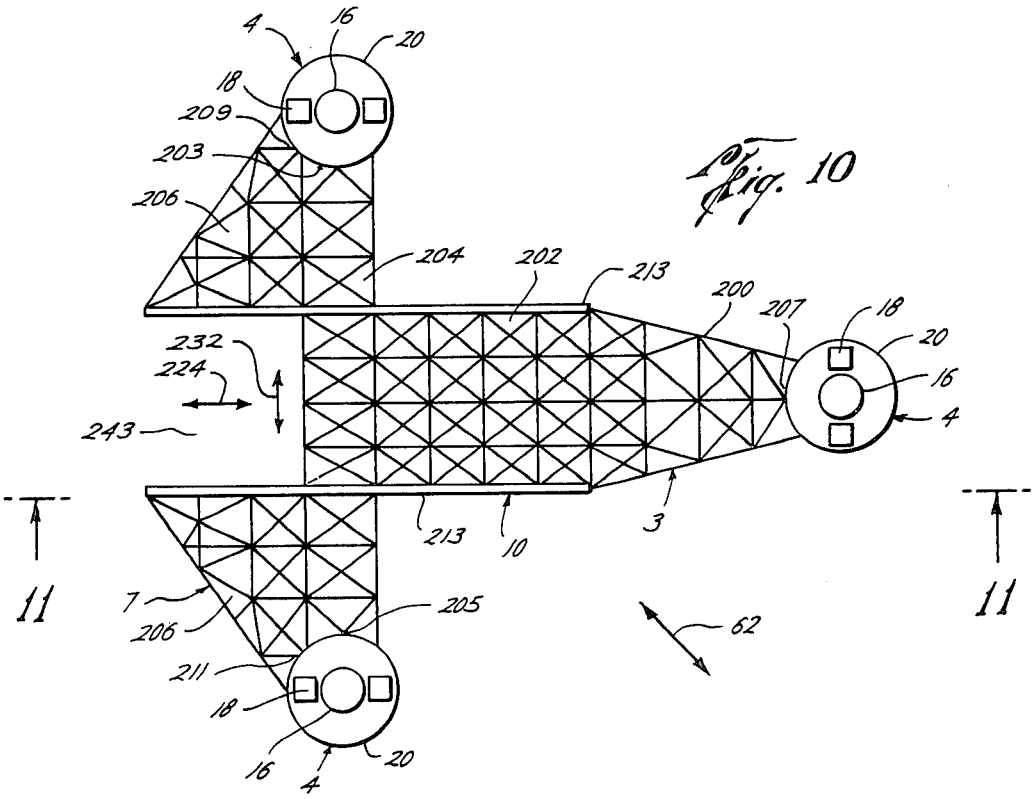
FIG. 10 is a plan view of Embodiment 3 of the apparatus of the present invention not showing the drill works.
Figures 11, 16:
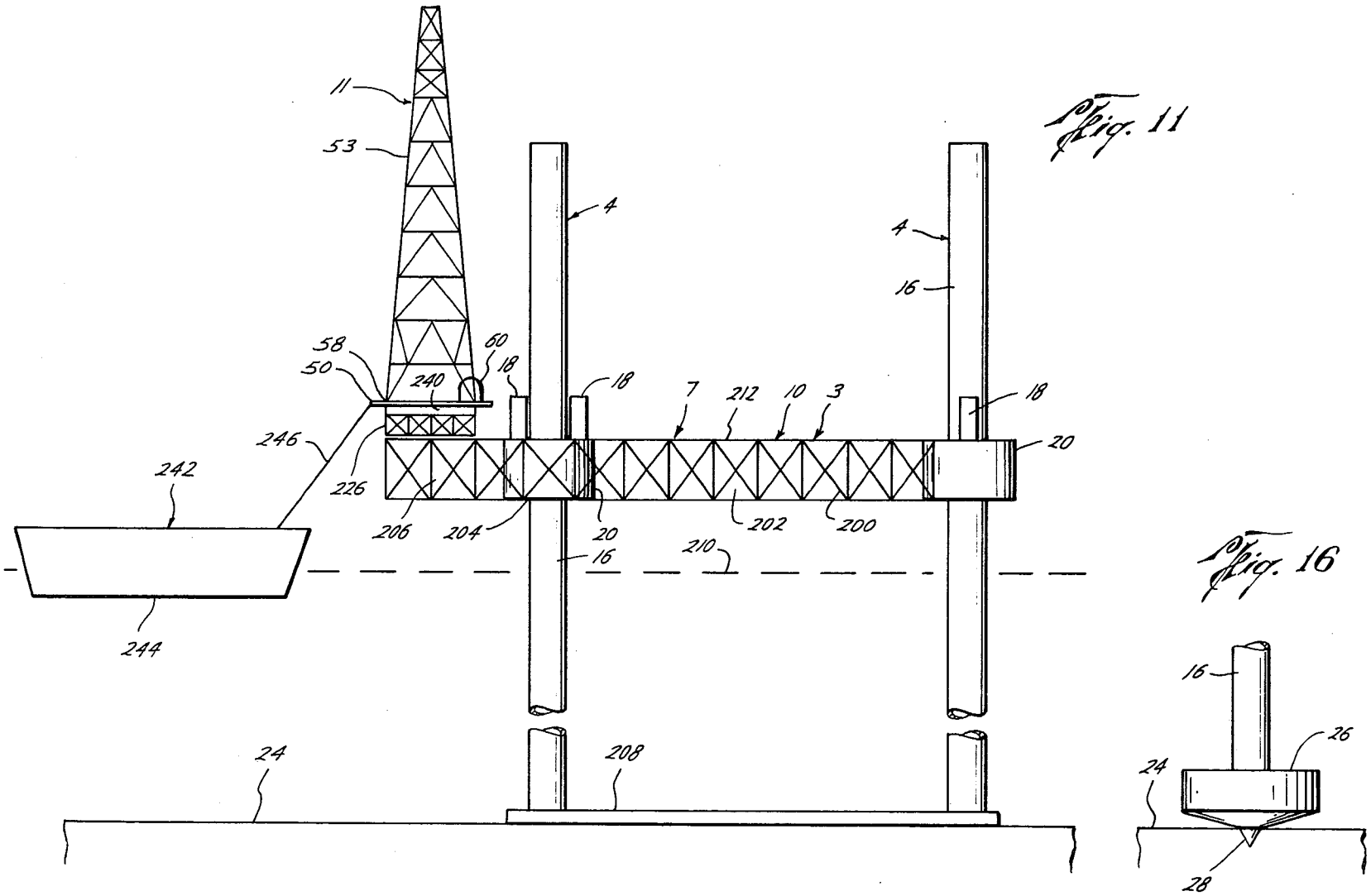
FIG. 11 is a side cross-sectional view taken along section lines 11—11 of FIG. 10 also showing the drill works and pipe ramp and ladder in place.
FIG. 16 is an elevational view of a spud can.
Figure 12:
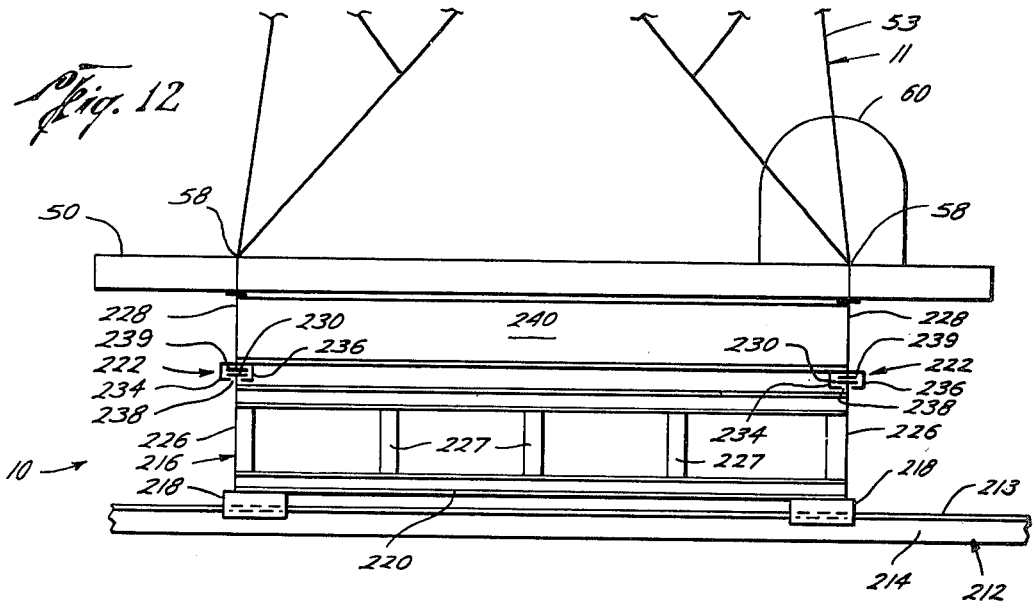
FIG. 12 is a side, detailed view, partially in elevation and partially in cross-section, of the drill works mounted on the lower skid rail of Embodiment 3 of FIG. 10 of the apparatus of the present invention.

Referring now to FIG. 10, 11, and 12, there is shown rig 3 having openwork truss structure 7. Truss structure 7 comprises reinforcing member 200 connected to longitudinal truss members 202, transverse truss members 204 and cantilever force distribution truss structures 206. Truss structures 206 form well 243. Truss structure 7 is in the shape of a maltese cross thereby permitting drilling works 11 to be operated in a slot configuration over well 243. The components of the truss members are of the same type as rig 1. The ends 203, 205 of truss beam 204 and the end 207 of reinforcing member 200 connect to preload pods 20 to support truss structure 7 on leg structure 4. Also, ends 209, 211 of slot force distribution structures 206 connect to preload pods 20 to further distribute load into leg structure 4.

As previously discussed, jacks 18 mounted on preload pods 20 engage legs 16 thereby connecting them to preload pods 20 and therefore to truss structure 7. In Embodiment 3, the ends of the lower portion of legs 16 below preload pods 20 are connected to mat 208. Therefore, as legs 16 are jacked downward by jacks 18, mat 208 will come to rest on bottom 24 thereby supporting legs 16 and, hence, rig 3 above water surface 210 in the same manner as the spud cans 26 for rigs 1 and 2.

Skid system 10 permits fore and aft movement and transverse movement of drill works 11. It comprises lower skid rails 212 having horizontal member 213 and vertical member 214 for fore and aft movement 224. Carriage 216 is connected by lower skids 218 to the horizontal member 213 of lower skid rail 212. Lower skids 218 are connected to carriage 216 at lower carriage beam 220 by welding or other suitable means to form a channel of suitable size for sliding engagement with horizontal member 213, permitting movement of drill works 11 in the general direction indicated by arrows 224. Vertical structural supporting shapes, such as, for example, wide flange beams 226 and 227 of carriage 216, support upper beams 228 on lower structural supporting shapes such as, for example, wide flange beams 220 with surface 230 of vertical wide flange beams 226 forming the upper transverse skid rail. Upper skids 222, as with the upper skids 106, are of two sections 234, 236. The top of these sections are connected by welds to upper carriage 228 and the bottom of the sections have an opening to form channel 238. Channel 238 is sized for slidably engaging skid surface 239 of upper carriage 228 with upper skid rail 230 and for holding upper skid 230 within channel 238 to permit transverse movement of the drill works 11 as generally shown by direction arrow 232.

Floor 50 mounts directly on beam carriage 228. Therefore, bases 58 of derrick 53 may be positioned on floor 50 directly above upper skids 222 to distribute the weight of the derrick 11 through beam 240 and upper carriage 228 to skids 222, and 218 and thence to the truss structure 7 of rig 3.

As with rigs 1 and 2, rig 3 is a tender assisted rig using tender 242, which may be a barge or semisubmersible for rough seas or ship. The use of the semisubmersible for this non-drilling application would require its base portion 244 to be less strongly reinforced than a semisubmersible adapted for drilling. Therefore, it may be less expensive in combination with an openworks rig than a semisubmersible adapted for drilling. Tender 242 is connected to drill works 11 by pipe ramp and personnel transportation facilities 246 such as, for example, a ladder.

Figure 17:
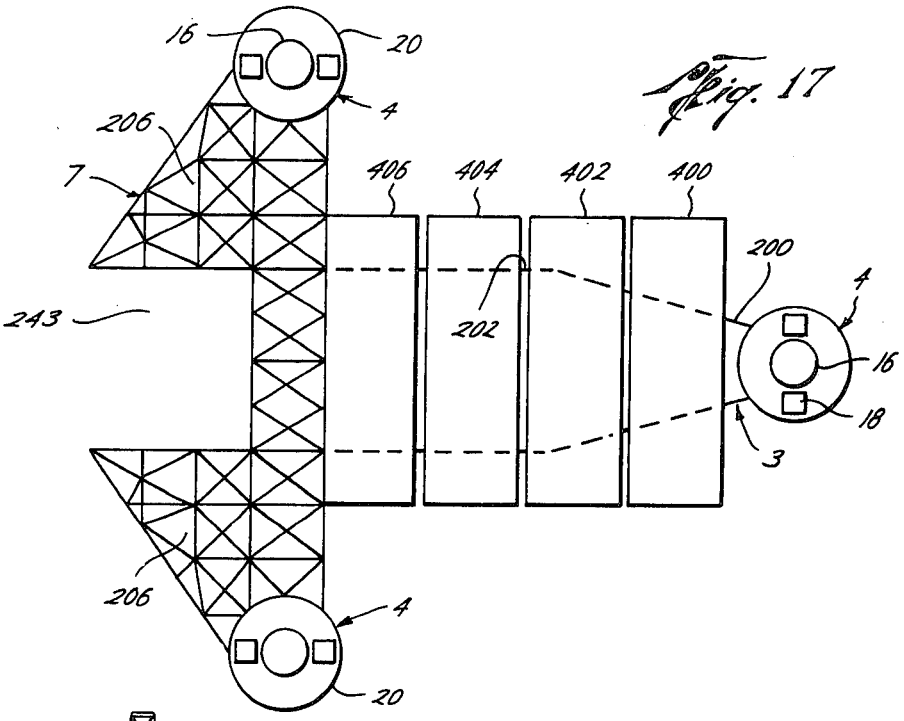
FIG. 17 is a plan view of Embodiment 3 of the apparatus of the present invention showing the rig as a production platform.
Figure 18:
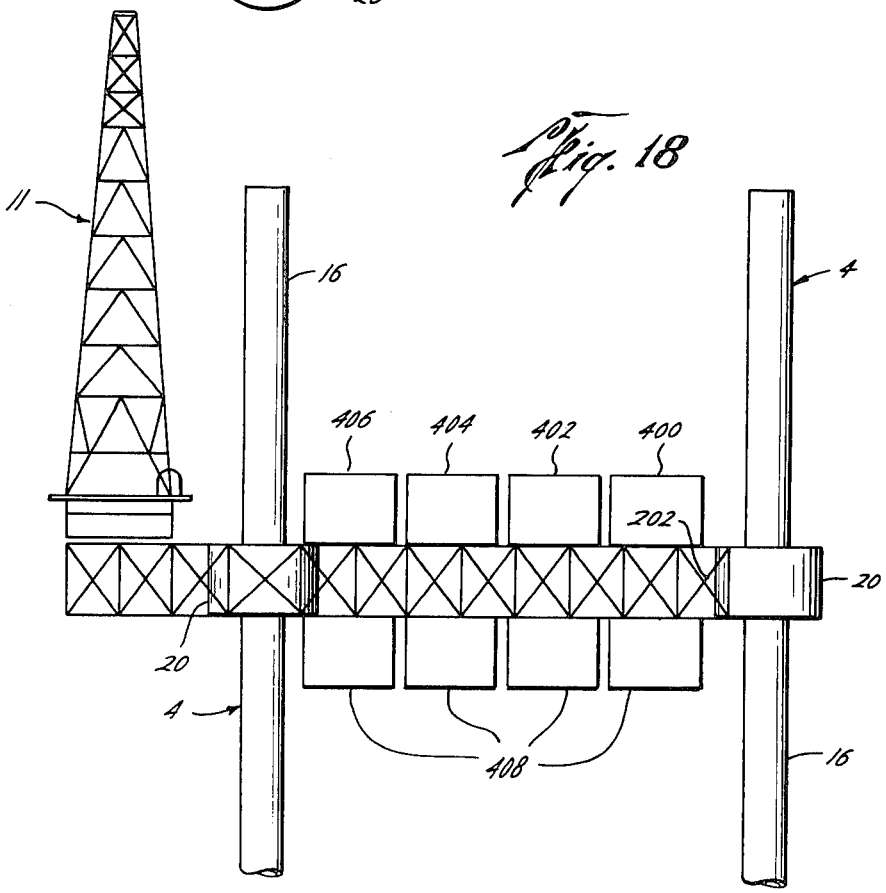
FIG. 18 is a side elevational view of Embodiment 3 of the apparatus of the present invention showing the rig as a production platform with modules located on the superstructure and suspended below the superstructure.

Referring to FIG. 12, the height between drill floor 50 and lower skid rail 212 may be such that drill works 11 may be used to hoist and locate modules of equipment such as, for example, mud pumps and quarters (FIGS. 17, 18). These modules may be unloaded from a ship (not shown) located under well 243 by the drill works, suspended under drill floor 50 and moved along the skid system 10 to the appropriate position, and located on truss member 202 (FIGS. 17, 18).

Transportation Mechanism

Figure 13:
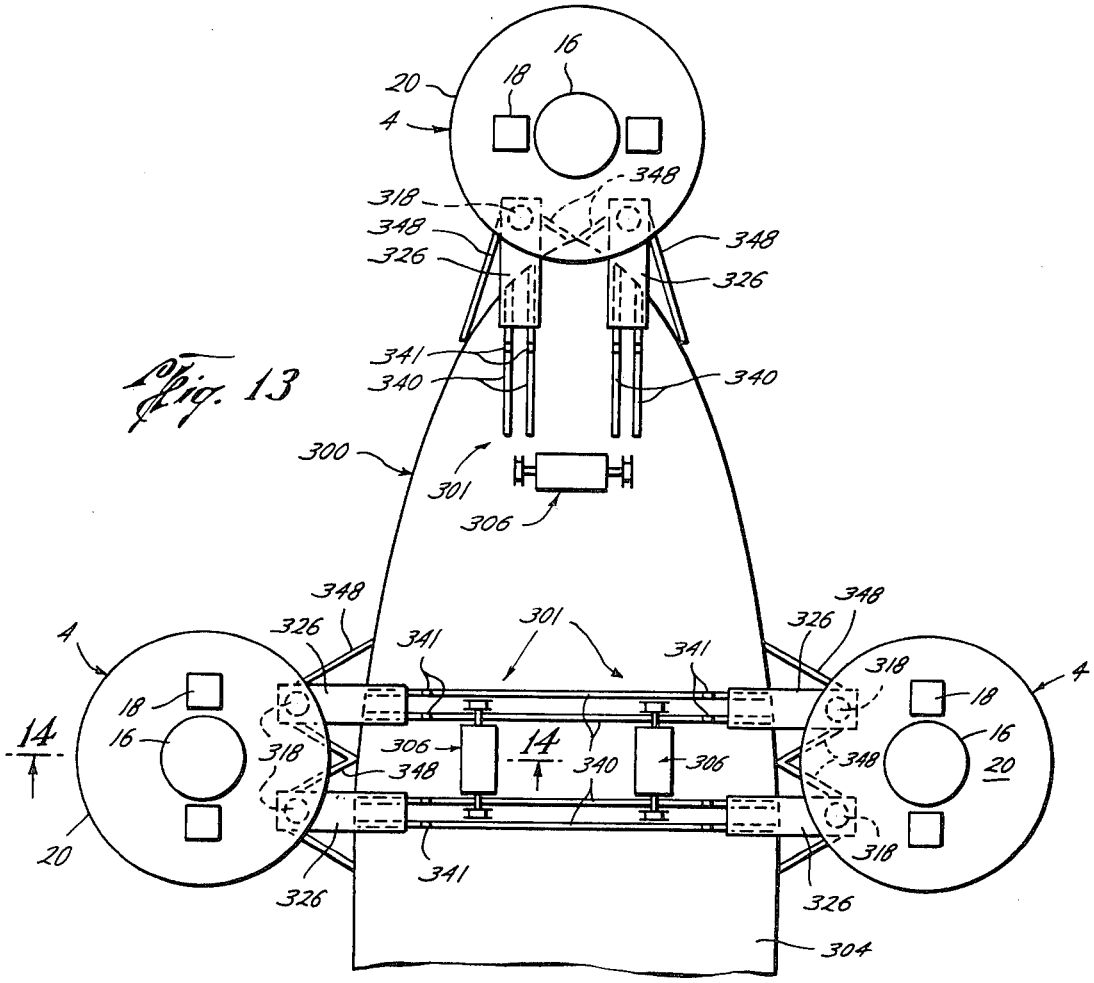
FIG. 13 is an elevated view of the preferred embodiment of the apparatus of the present invention showing the relation of a ship to preload pods of a rig with the superstructure of the rig not shown.
Figure 14:
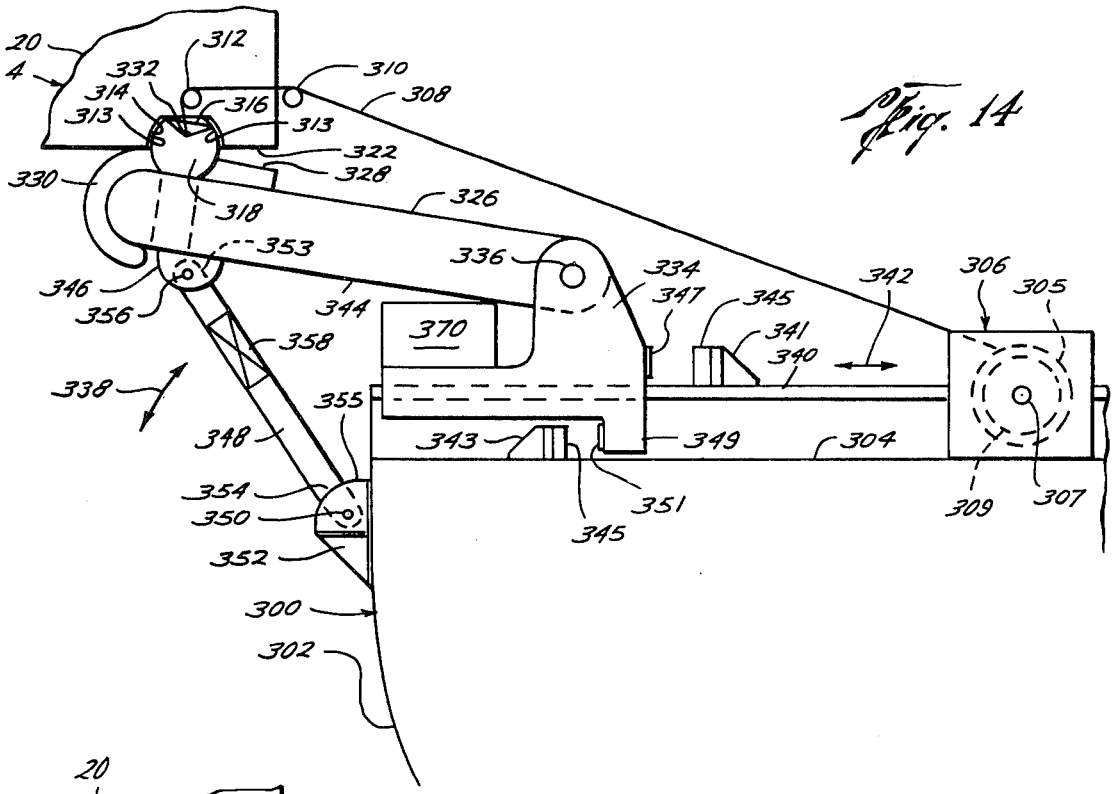
FIG. 14 is a side section taken along section lines 14—14 of FIG. 13 showing the ship in position to receive the rig.
Figure 15:
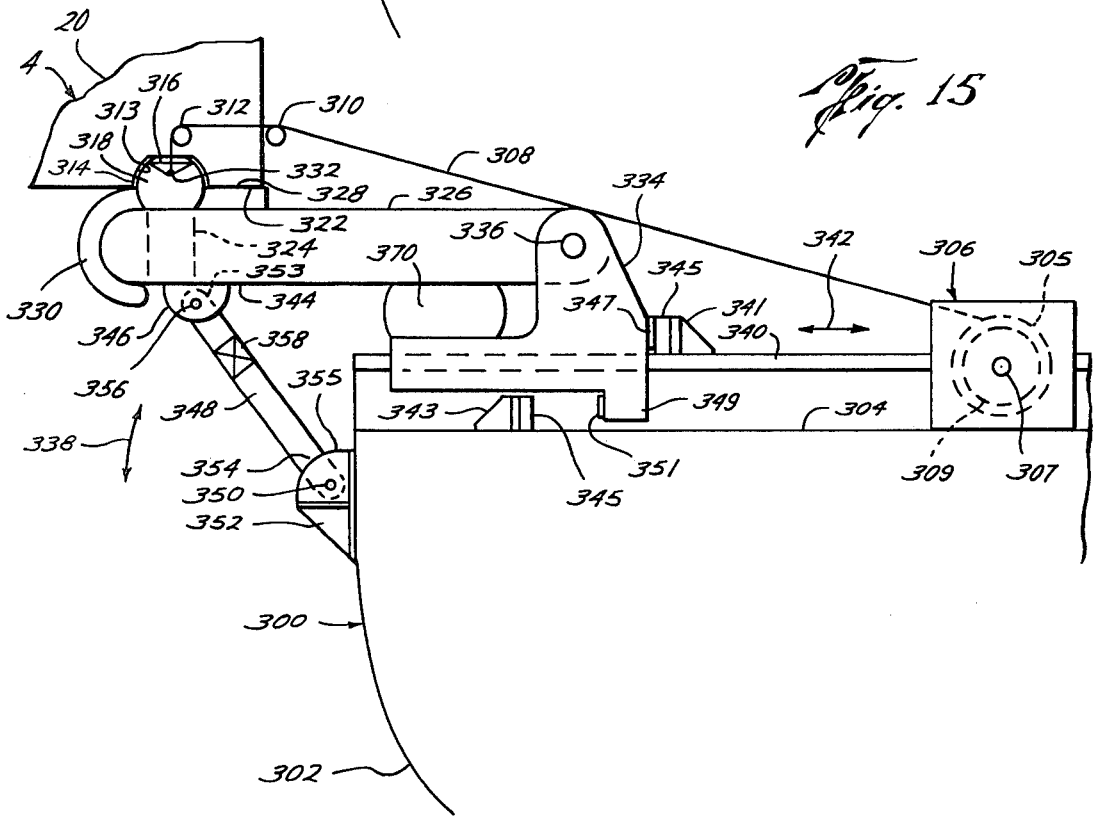
FIG. 15 is a side section taken along section lines 14—14 of FIG. 13 showing the ship carrying the rig.

Referring particularly to FIGS. 13, 14 and 15, a vessel, such as, for example, barge or semisubmersible or ship 300 comprising hull 302 and deck 304 is used to transport rigs 1, 2, 3 to drilling or work over sites. A plurality of winch driven lifting mechanisms 301 are provided on deck 304 and pinned to hull 302 to engage preload tanks 20 and resiliently bear the weight of rigs 1, 2 or 3 on ship 300 as legs 16 are jacked up off the ocean bottom.

Mechanisms 301 include winches 306. Winch 306 comprises drum 305 with axle 307 therethrough located on deck 304. Wire rope bundle 309 is wound on drum 305. Line 308 extends from bundle 309 of winch 306 to pulleys 310, 312 mounted on preload tank 20 of leg structure 4. Pulleys 310, 312 are located in preload tank 20 to align guideline 308 within socket 314. Socket 314 includes lining 313. Socket 314 forms indentation opening 316 in preload tank 20 bounded by flat surface 322 and is sized to receive semicircular steel ball 318 therein. Steel ball 318 includes an anchor 332 for attachment of line 308.

Steel ball 318 is rotatably mounted in holder 324 of beam 326 and supported by beam 326. The outboard surface of beam 326 is covered with rubber bumper 330 located and sized to resiliently contact surface 322 of preload tank 20 (FIG. 15) for support.

Beam 326 is hinged to a stand 334 by hinge pin 336, permitting beam 326 to rotate about hinge pin 336 as generally shown by direction arrows 338. Beam 326 is of sufficient length for steel ball 318 to engage socket 314 and fill opening 316. Base 334 is slidably mounted on skid rails 340 with a sufficiently low coefficient of friction to permit base 334 to slide on skid rails 340 while bearing the full weight of rigs 1, 2, or 3 during action of engagement of the rig and the ship. The direction and movement of base 334 is generally indicated by arrows 342.

Stops 341, 343 are provided on the inboard and outboard sides of base 334 to restrict its movement along skid rails 340. Each stop 341, 343 is provided with a resilient pad or spring 345 of sufficient resiliency to cushion the impact of base 334 against the stop 341, 343. Resilient pads 347 are provided on the inboard side of base 334 at a position to be juxtaposed with resilient pads 345 upon impact of base 334 with stops 341. Extensions 349 are disposed on the lower end of base 334 facing opposite deck 304 with pads 351 mounted thereon facing opposite pads 345 of stoop 343.

The outboard end 344 of beam 326 includes support extensions 346. Support extensions 346 are supported by the upper end of 353 of support bar 348, rotatably connected thereto by hinge pin 356. Support bar 348 is rotatably connected at its lower end 354 by hinge pin 350 to hull support 352 by extension 355 mounted on the upper end of support 352. Shock absorber 358 is provided as a part of support 348 with sufficiently resiliency to dampen the impact forces applied by rigs 1, 2, or 3 to slip 300 as the rig weight is placed on beams 326 both initially and by sea action.

Rubber pad 370 is located on base 334 between base 334 and beam 326 with additional resiliency to absorb the impact forces and limit rotation of beam 326.

As best shown in FIGS. 1, 6, 10, 13, when rigs 1, 2, 3 are to be transported to a location for drilling or work over, ship 300 approaches rigs 1, 2, 3 in the general direction of arrow 62, i.e. from a side between two legs. Guidelines 308 (FIGS. 14, 15) are then strung for each leg structure 4 from bundle 309 would around drum 305 of winch 306 over pulleys 310, 312. From pulleys 310, 312, guidelines 308 are then strung, through socket 314 to connection 332 of steel ball 318. This may be done for all three leg structures 4 simultaneously. The connection of the guidelines 308 through the pulleys 310, 312 on the preload tanks 20 may be done while the ship 300 is located at a considerable distance from the rig 1, 2, 3, such as, for example, one hundred feet, without danger of collision of the ship 300 with the rig 1, 2, 3.

The winches 306 are then activated drawing the ship 300 under preload tanks 20 and rotating beams 326 toward preload tanks 20 thereby expanding shock absorber 358 as steel balls 318 are drawn to sockets 314. When the steel balls 318 have filled space 316 of socket 314 and surface 322 has come in contact with surface 328 of rubber bumpers 330 at the outboard end, thereby centering port and starboard bases 334 along skids 340 between stops 341 and 343, jacks 18 may be activated.

As best seen in FIG. 15, when jacks 18 are activated, they raise the legs 16 to the required clearance above water surface 210 thereby placing the weight of rigs 1, 2, 3 on ship 300. This will cause beam 326 to quickly rotate downwardly until shock absorber 358 and rubber pad 370 are compressed to firm resistance, absorbing the shock of the impact force of the rig weight.

Winches 306 may have tension varied so that ship 300 and lifting mechanisms 301 will stay substantially centered between the port and starboard pods 20. As the weight of rigs 1, 2, 3 is applied to ship 300, port and starboard bases 334 will move further along skids 340 to adjust the spacing between port and starboard steel balls 318 to the spacing between the corresponding sockets 314 of preload tanks 20.

After legs 16 have been jacked to the extent necessary for transportation and the rig secured on ship 300, ship 300 may then carry the rig 1, 2, 3 to its location. Upon arriving at the drilling site, jacks 18 are again activated to lower leg 16 downwardly towards the bottom 24. As legs 16 are lowered, and move farther below the hull 302 of ship 300, the lower portion of leg 16, either mat 208 or spud can 26, will experience increasingly greater transverse and vertical movement caused by the pendulum effect of movement of ship 300 under wave action. Therefore, as either mat 208 or spud can 26 reaches bottom 24, there will be impact reactions caused by the movement of the legs 16 being stopped by the ocean bottom 24. To avoid excess impact forces on the legs, the landing operation is usually carried out during periods of relatively cam seas. Even under these circumstances, there is a high potential with heavy, seaworthy jack-up rigs, whether or not mounted on a ship, to shear, bend or otherwise damage a leg upon contact of the leg with the ocean bottom 24. However, because rigs 1, 2, 3 are lightweight, having openwork bodies requiring less steel for the body and consequently less steel per foot of leg, and because shock absorbers 358 and pads 370 are provided to absorb impact forces, the danger of impact forces damaging legs 16 is reduced, and the legs may be set on the ocean bottom in heavier seas.

After mat 208 or spud cans 26 have reached the bottom, jacks 18 will continue to lift rigs 1, 2, 3 above the surface 210 of the water and deck 304. If insufficient or no preload pods are provided, the rigs may be jacked up almost off the buoyant ship 300 and preloaded using the weight of the buoyant ship. After the rig is no longer dependant on the buoyant ship 300 for support, the ship 300 may be withdrawn a sufficient distance from the rig to permit disengaging of guidelines 308. This withdrawal is usually performed under tension of the guidelines 308 and the ships' engines and/or standby tug boat engines (not shown) to safeguard the ship 300 from colliding with the rig. After sufficient extension, guidelines 308 are released from ball 318 and pulleys 310, 312. Ship 300 can then be disengaged and may then become tender assisting if desired, acting as tender 242.

Operation of the Rig

After the rig 1, 2, 3 is properly located, elevated, and secured to the ocean bottom 24, such as, for example, by use of preload pods 20 to force extra load on leg structures 4, and the equipment located on floor 50, if it was not transported on floor 50, the rig 1, 2, 3 is ready for drilling. The drill works 11 may be oriented with regard to the selected position on bottom 24 where drilling is to commence. To orient the rig 1, lower skids 42 are activated to azimuthally position drill works 11 on circular skid rail 30. Upper skids 54 are then activated on upper skid rails 40 to position the drill works 11 along the diameter selected through orientation on circular skid rail 30. To orient rig 2, lower skids 42 are first activated to position drill works 11 azimuthally on a selected diameter of circular skid rail 30. Upper skids 106 are then activated to provide movement on lower flange 110 to position drill works 11 along the diameter selected or along the projection of the diameter beyond the perimeter of circular skid rail 30. In this manner, drill works 11 may become cantilevered as shown in FIGS. 6 and 8 or may work in the areas between the sets of legs. To orient rig 3, drill works 11 is oriented by first activating lower skid 218 for fore and aft movement of drill works 11 bringing drill works 11 over well 243. After lower skid 218 has been properly positioned along lower skid rail 212, upper skid 222 is activated to transversely position drill works 11 within well 243 to locate hole 52 over the desired position (not shown) on bottom 24.

Referring to FIG. 17, after drilling is completed and the wells are also completed, the drill works 11 may be removed. The rig, such as rig 3, because of its lightweight, openwork body lowering construction cost, may then be economically converted to a production platform. Modules such as crew quarters 400, generators 402, machinery 404, and mud pits and machinery 406 may be loaded on truss member 202 (FIG. 17) by drill works 11 as described in Embodiment 3 or by an external crane (not shown). These and additional modules 408 may also be suspended from truss member 202 (FIG. 18). The drill works 11 may be removed, if required, either prior to or after the mounting of the modules. Preload pods 20 may be used for storage for fuel oil and drilling water.

Figure 19:
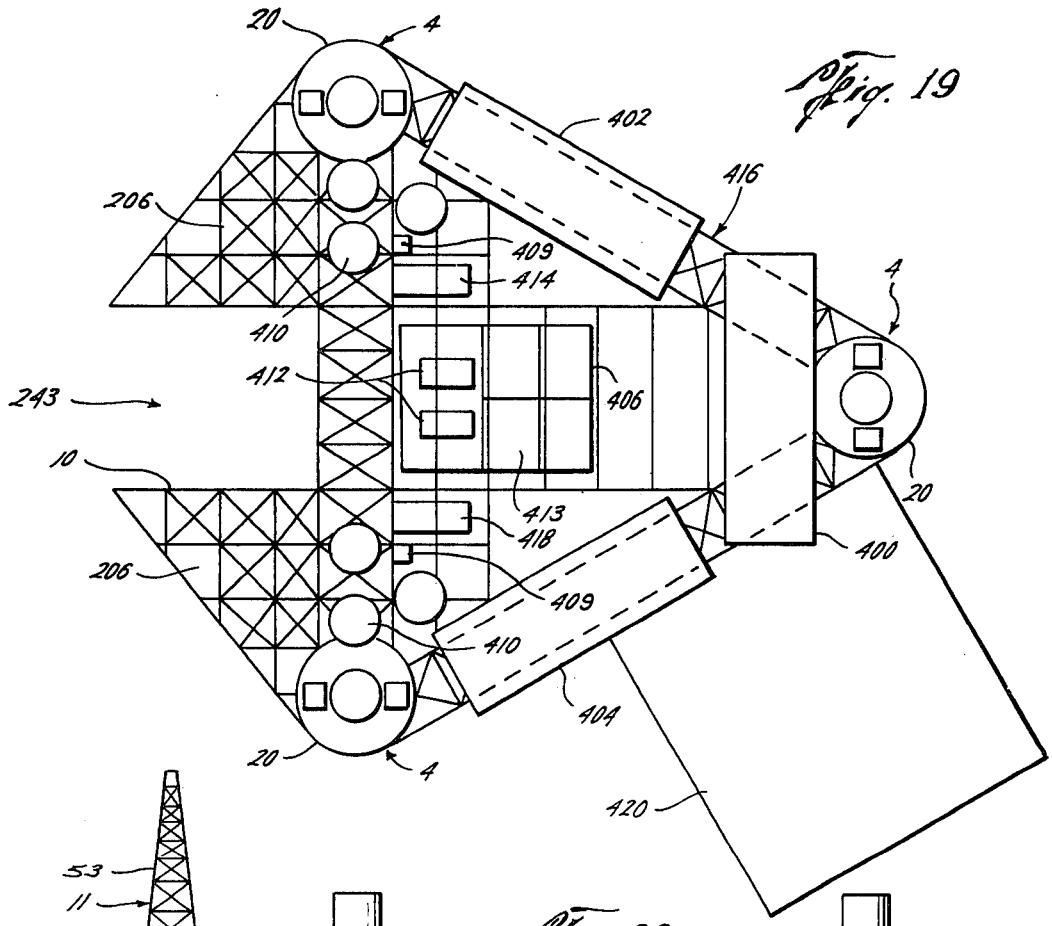
FIG. 19 is a plan view of a triangular shaped, non-seaworthy rig with a reinforcing structure for cantilever operation using the skid structure of Embodiment 3.
Figure 20:
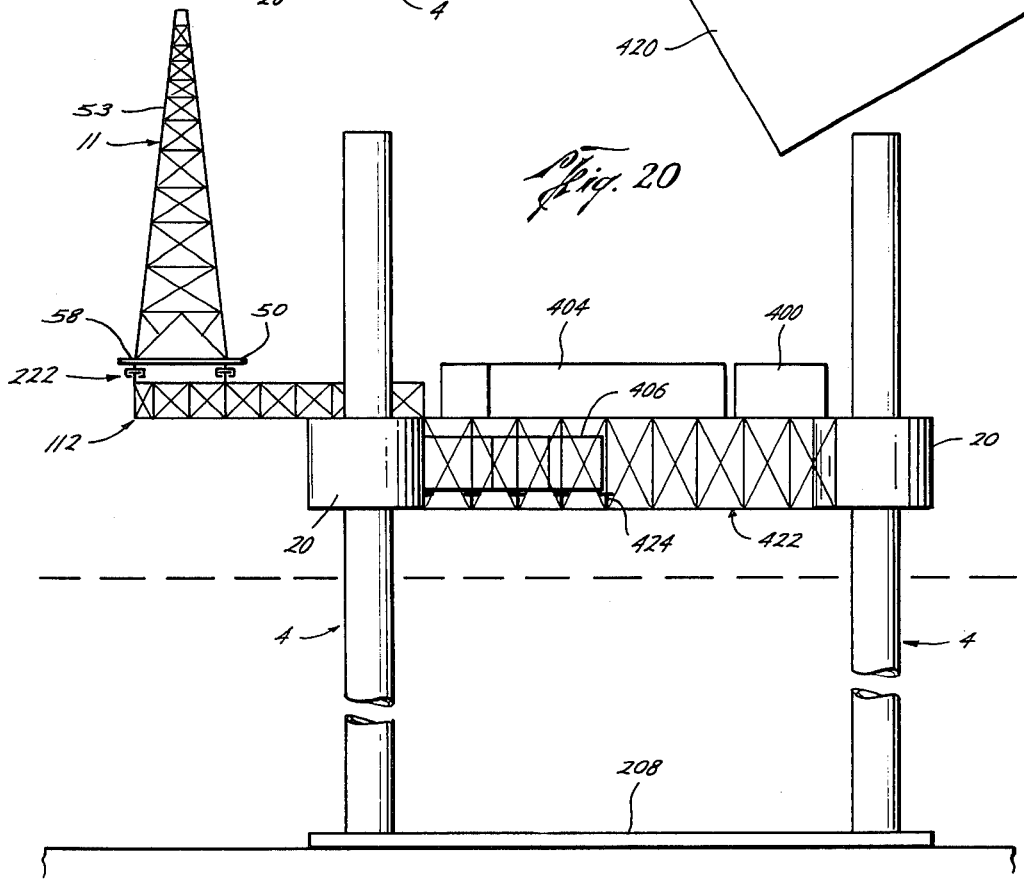
FIG. 20 is a side, elevational view of a cross-shaped cantilever rig showing drilling equipment for sustaining drilling operations without tender assistance and with mat engagement for footing on the ocean bottom.

Referring to FIGS. 19 and 20, modules may also be used to provide the necessary facilities to permit jack-up rigs having openwork bodies to be self sufficient, requiring no tender assistance. As best seen in FIG. 19, rig 416 is a triangular shaped, slot rig using a superstructure similar to a combination of that of Embodiments 1 and 3. Rig 416 is also provided with leg structure 4 and, additionally, reinforced slot structure 206 forming well 243 such as that of Embodiment 3. A skid system 10 is also provided such as that of Embodiment 3. Superstructure 3 includes support modules to provide all necessary support for drilling operations such as quarters 400, generators 402, machinery 404, mud module 406 including mud pumps 412 and mud pit 413, cranes (not shown) on crane pedestals 409, pressure tanks 410, cement unit 414, shale shaker degasser and desilter and desander 418, and heliport 420. Fuel oil and drill water may be stored in preload pods 20, if necessary.

As best seen in FIG. 20, rig 422 is a cross shaped, cantilever rig using a superstructure similar to that of Embodiment 2. Rig 422 is also provided with leg structure 4 including mat 208 such as that of Embodiment 3. Additionally, rig 422 includes cantilever beam 112 such as that of Embodiment 2 and upper skid system 222 such as that of Embodiment 3. The mud pump and mud pit module 406 is located below the pipe rack and in the superstructure, resting on structural members 424.

Although the system described in detail supra has been found to be most satisfactory and preferred, many variations in structure and method are possible. For example, the legs can be of any shape including round, three cord triangular, or four cord square legs of either solid or truss structure. The rig may be square or rectangular in shape with four leg segments used instead of three. During transportation, the rig may be dismantled and carried on the deck of a tender or transportation vessel so that it can be transported through narrow channels or rivers. Any type of transportation vessel such as a ship, barge, or semisubmersible may be used. Additional machinery may be located on the floor 50 of the rig to minimize or eliminate tender assistance. Box beams may be used instead of trusss structure. Either spud cans or mats may be used with any of the rigs. The platform can be mounted so that it does not revolve about the center of the circular skid rail 30. The rig may be used to support cranes, quarters, or other apparatus in addition to or instead of the drill works. All of the equipment located on floor 50 may be transported separately on the same or a different vessel. The skid rails may be of any curved shape.

The above are exemplary of the possible changes or variations.

Because many varying and different embodiments may be made within the scope of the inventive concept herein taught and because many modifications may be made in the embodiment herein detailed, in accordance with the descriptive requirements of law, it should be understood that the details herein are to be interpreted as illustrative and not in a limiting sense.

I claim:

1. Method of transporting a structure for erection offshore having a truss work portion and three elongated members extending therefrom each connected thereto at only one end, comprising placing said structure in a position on one end of a ship with two of said members extending vertically down on opposite sides of the ship and the third member extending vertically down at the end of the ship, and causing said ship to move to location while maintaining said structure in said position.

2. Method of claim 1 wherein said end is the stern of the ship, said members extend into the water, and the ship is moved forwardly dragging said third member behind.

3. Method of claim 1 wherein said end is the bow of the ship, and said members do not extend into the water whereby when the ship is moved forwardly the legs create no drag.

4. Marine structure comprising an elongated vessel and an offshore tower-like structure carried thereon including three members extending from the remainder of the structure in the same general direction having a batter of less than 30 degrees and a length of the same order of magnitude as the deck height of the ship relative to its bottom, said structure being disposed at one end of the vessel with its axis vertical and said three members disposed one at each side of the ship and one off the end.

5. Structure according to claim 4 wherein the members are legs and extend into the water when the vessel is floating.

6. Structure according to claim 4 wherein the members are adapted to receive legs and do not extend into the water.

* * * * *

UNITED STATES PATENT AND TRADEMARK OFFICE

CERTIFICATE OF CORRECTION

PATENT NO. : 4,065,934

DATED : January 3, 1978

INVENTOR(S) : Edward David Dysarz

It is certified that error appears in the above-identified patent and that said Letters Patent are hereby corrected as shown below:

Column 3, line 53: After "Structure", delete "of" and insert -- and --.

Column 5, line 67: After "to", delete "FIG." and insert -- FIGS. --.

Column 6, line 59: After "a", delete "semis-" and insert -- semi- --.

Column 6, line 60: Delete "ubmersible" and insert -- submersible --.

Column 7, line 57: After "of", delete "stoop" and insert -- stop --.

Column 7, line 65: After "with", delete "sufficiently" and insert -- sufficient --.

Column 7, line 67: After "to", delete "slip" and insert -- ship --.

Column 8, line 4: After "best", delete "shown" and insert -- seen --.

Column 8, line 9: After "309", delete "would" and insert -- wound --.

UNITED STATES PATENT AND TRADEMARK OFFICE

CERTIFICATE OF CORRECTION

PATENT NO. : 4,065,934
DATED : January 3, 1978
INVENTOR(S) : Edward David Dysarz It is certified that error appears in the above-identified patent and that said Letters Patent are hereby corrected as shown below:

Column 8, line 59: After "relatively", delete "cam" and insert -- calm --.

Column 11, line 10: Before "an", delete "and" and insert -- with --.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*